US007422060B2

(12) United States Patent
Hammami et al.

(10) Patent No.: US 7,422,060 B2
(45) Date of Patent: Sep. 9, 2008

(54) METHODS AND APPARATUS FOR COMPLETING A WELL

(75) Inventors: Ahmed Hammami, Edmonton (CA); Gerald H. Meeten, Ware (GB); Bernadette Craster, Waterbeach (GB); Scott Jacobs, Edmonton (CA); Joseph A. Ayoub, Katy, TX (US); Philippe Lacour-Gayet, New York, NY (US); Jean Desroches, Paris (FR); Simon G. James, Le Plessis-Robinson (FR); Saad Bargach, Houston, TX (US); Gary L. Rytlewski, League City, TX (US); Iain Cooper, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/161,003

(22) Filed: Jul. 19, 2005

(65) Prior Publication Data

US 2007/0017675 A1 Jan. 25, 2007

(51) Int. Cl.
*E21B 33/13* (2006.01)

(52) U.S. Cl. ..... 166/281; 166/308.1; 166/298; 166/285

(58) Field of Classification Search ..... 166/242.1, 166/278, 285, 292, 293, 296, 297, 376
See application file for complete search history.

(56) References Cited

U.S. PATENT DOCUMENTS

| | | | | |
|---|---|---|---|---|
| 3,026,936 | A * | 3/1962 | Teplitz | 166/285 |
| 4,531,583 | A | 7/1985 | Revett | |
| 4,673,039 | A * | 6/1987 | Mohaupt | 166/281 |
| 5,425,424 | A * | 6/1995 | Reinhardt et al. | 166/291 |
| 2004/0180793 | A1 | 9/2004 | Ramos | |
| 2005/0121203 | A1 | 6/2005 | Richard et al. | |

FOREIGN PATENT DOCUMENTS

| | | | |
|---|---|---|---|
| EP | 0 426 427 | A2 * | 5/1991 |
| EP | 0 426 427 | A3 | 11/1991 |
| GB | 2 380 749 | A | 4/2003 |
| GB | 2380749 | A * | 4/2003 |

OTHER PUBLICATIONS

International Search Report and Written Opinion for International Application No. PCT/IB2006/002683, International Filing Date: Jul. 19, 2006; Applicant's Reference: 57.0680 WO PCT.

* cited by examiner

*Primary Examiner*—Jennifer H Gay
*Assistant Examiner*—Angela M DiTrani
(74) *Attorney, Agent, or Firm*—Steven Gahlings, Esq.; Jim McAleenan, Esq.; Jody Lynn DeStefanis, Esq.

(57) ABSTRACT

Methods and tools are described to reduce sanding including the steps of fracturing the cement sheath in a localized zone around the casing and having the fractured zone act as sand filter between the formation and openings in the casing, with the openings being best pre-formed but temporarily blocked so as to allow a conventional primary cementing of the casing. The fracturing step can also be used for remedial operation to reopen blocked formation or screens.

18 Claims, 8 Drawing Sheets

METHODS AND APPARATUS FOR COMPLETING A WELL

BACKGROUND OF THE INVENTION

This invention relates to methods and apparatus for completing a well. More specifically the present invention relates to methods and apparatus for reducing the amount of abrasive or blocking solid particles such as sand from subterranean formation entering the wellbore in either an initial completion of the well or in remedial operations to improve an initial completion.

Certain underground formations encountered in the drilling of wells such as oil and gas wells are sometimes prone to sanding during the production phase. Sand when produced along with the fluids from the formation can cause severe problems with the ability of the well to produce the desired fluids due to blockage by the produced solids and damage done to installations due to the abrasive nature of such particles.

Wellbores drilled in sanding-prone reservoirs can be completed either in a cased hole configuration or in an uncased (open-hole) configuration. For cased hole completions, a casing string, typically formed from a series of steel tubes joined end to end, is cemented in place in the wellbore. The simplest cement placement is primary cementing where a fluid train comprising a cement slurry is pumped from the surface into the wellbore through the casing string, returning towards the surface along the annular gap between the casing and the formation. The cement sets in the annulus behind the casing to form a material that supports and protects the casing and provides zonal isolation.

At present, open hole (uncased) reservoir completion of a sanding-prone reservoir is often a complicated and expensive procedure requiring the use of hardware to prevent the sand production from the reservoir during the production phase.

Common current ways to prevent sanding include;

gravel packing after placing tools and screens in the hole;

placement of a prepacked screen in the open hole;

use of expandable screen completions; and reservoir sandface consolidation, for example using resin.

The gravel packing process requires the use of a special tool and incomplete placement of gravel is a well-known risk particularly in horizontal reservoirs. Pre-packed screens eliminate the risk of voids but require special complex placement.

U.S. Pat. No. 3,026,936 proposes to facilitate well production through the use of fractures in cement. Fracturing of cement in a vertical well is proposed by use of bullets, mechanical hammers, hydraulically activated pistons and casing deformation through increased hydraulic pressure. Additionally, increasing permeability is proposed by chemical treatment.

The use of casing liner with pre-weakened (plugged holes) zones is proposed in U.S. Pat. No. 4,531,583 which describes a cement placement method for remediation of channels between casing and cement. Another use of casing liner with pre-cut holes is described in the United States published patent application No. 2005/0121203 A1 as expanded liner to be brought into direct contact with the wellbore wall.

SUMMARY OF THE INVENTION

This invention aims to improve on the previously proposed techniques by localizing the fracturing of the cement. In particular U.S. Pat. No. 3,026,936 to Teplitz has early recognized the potential of producing a well through a shattered sheath of cement and perforated casing. The proposal of Teplitz however has been largely ignored in favor of the above described apparatus and techniques which dominate the industry in the area of well production and sand control.

The present invention improves certain aspects which have been identified as major obstacles in implementing the method according to Teplitz. For example Teplitz fails to limit the propagation of cracks in the cement sheath thus creating the potential of unwanted crossflow between formation layers and loss of zonal isolation. Though referring to casing perforated prior to its placement in the well, Teplitz also fails to teach ways to place cement slurry through pre-perforated casing tubes.

The present invention provides apparatus and methods to localize the zone of fractured cement and in another aspect provides improved pre-perforated casing for the primary placement of cement slurries in the annulus between casing and formation.

In order to localize the fractured zone, the invention applies localized and preferably controlled forces or pressure on the sheath of cement (or any other settable material used to establish zonal isolation) along the wellbore. Preferably, the method comprises expanding the casing in the zone of interest so as to fracture the cement in the zone of interest by means of force- or pressure-transmitting elements.

Alternatively the zone or volume of fractured settable material is limited by a zone or volume of more compliant, and hence less brittle material located within the annulus. Perforated sections of the casing or liner are placed such that fluids from the surrounding formation passing through the fractured zones can enter the well through the perforations of the casing.

The zone or layer of fragmented material separating the casing and the producing formation is designed to prevent the entry of sand and other solid particles into the well. In other words, the fractured material between formation and casing acts as sand filter or sand screen.

At least a section of the casing can have a plurality of opening such as slots, screens, meshs and the like. The opening are preferably filled or blocked with removable filling elements or plugs during the primary placing of the settable material. The method according to this variant includes the further step of removing the filling elements or the plugs in the casing in the zone of interest prior to or during production of the well. Preferably, the removal of the filling elements or plugs occurs prior to fracturing the cement or after fracturing the cement but before producing the well. In a variant of this embodiment, however, the filling material may be removed using produced formation fluids.

These various aspects of the invention can be combined according to operational requirements. It is seen as being particularly advantageous to combine the aspects of localizing the fractures in the cement with the use of a pre-perforated casing to facilitate production. The invention can be applied to vertical and non-vertical or horizontal wells.

Another aspect of the invention comprises apparatus for fracturing locally the cement surrounding a casing in a well.

BRIEF DESCRIPTION OF THE DRAWINGS

The invention will now be described in relation to the accompanying drawings, in which.

DETAILED DESCRIPTION OF EXAMPLES AND VARIANTS

Figure 1A:
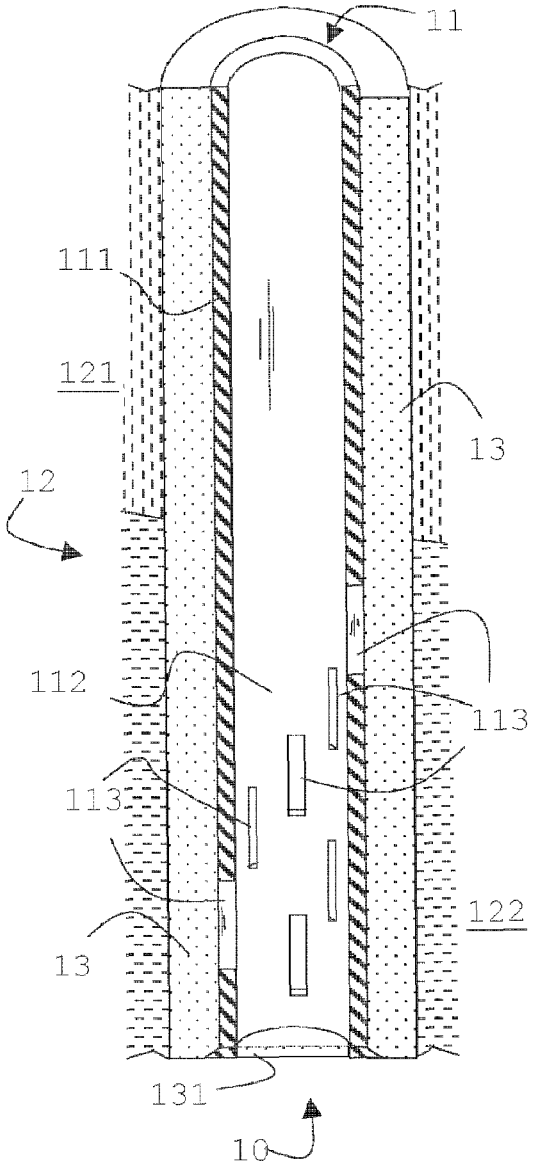
FIGS. 1A and 1B show one embodiment of the invention before and after fracturing.

One aspect of the invention concerns a primary cementing process that will provide a permeable material in front of producing zone. This process may happen in one stage or multiple stages. One embodiment of the invention is shown schematically in FIG. 1A. A casing string 11 is positioned in the well 10, with conventional steel casing 111 in front of the cap rock 121 or impermeable formation, and slotted casing 112 with a plurality of slots 113 in front of a permeable zone 122. A fluid train, comprising a cement slurry appropriate for the wellbore conditions is pumped from the surface along the casing 11 to fill the annulus between the casing 11 and the formation 12 thus forming an impermeable sheath 13 around the well. A cementing plug 131 may also be placed in the fluid train between the fracturable cement slurry and fluids remaining in the casing. This process will leave the hole either free to continue drilling, run tools, or to be filled with oil.

Figure 1B:
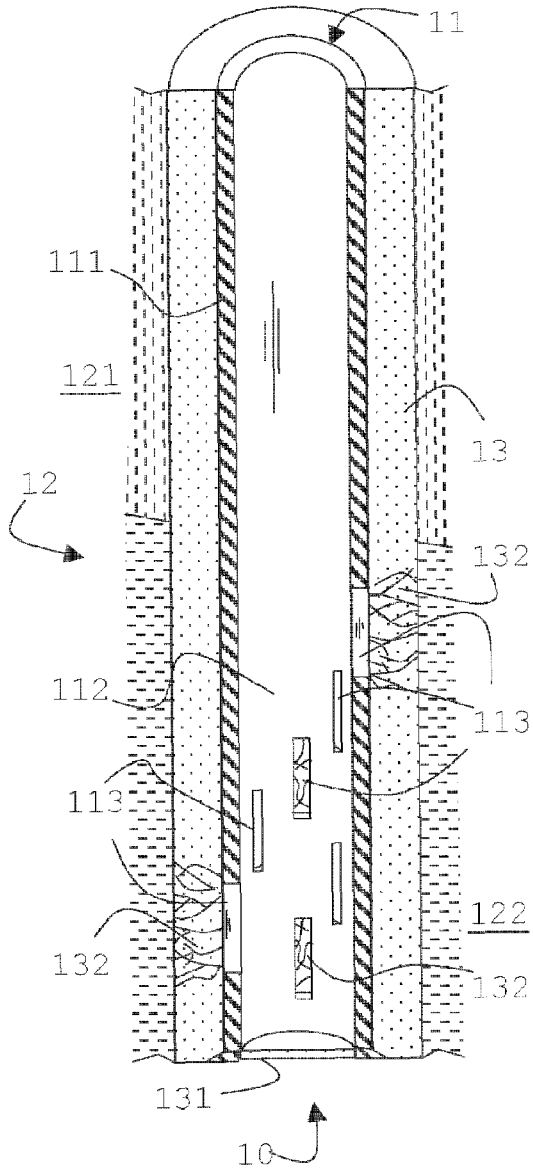

In FIG. 1B a fracturing force is applied to the cement to generate fractures 132 the set cement 13 locally in the zone around the slots 113. Details of suitable methods to confine the fractures within the desired zone will be described below.

Figure 1C:
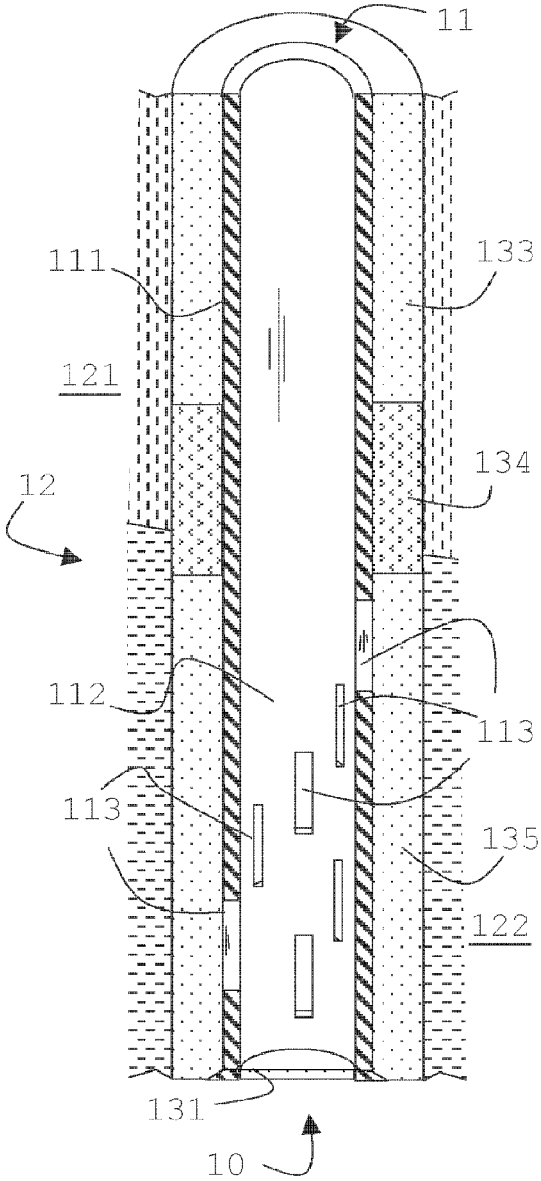
FIGS. 1C and 1D show another embodiment of the invention before and after fracturing.
Figure 1D:
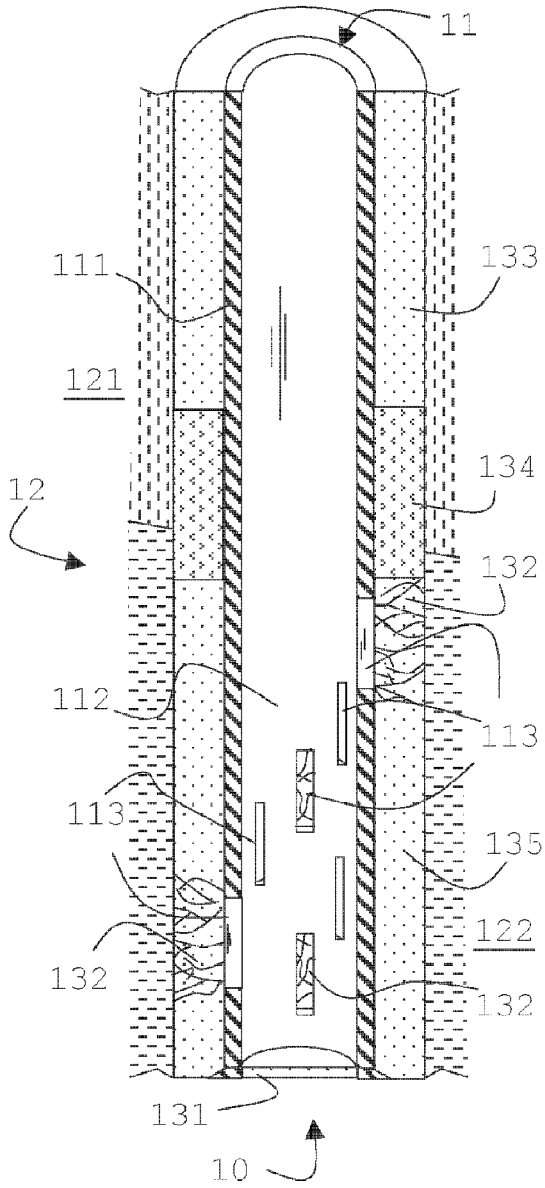

For example, in FIG. 1C a fluid train comprising a conventional cement slurry, followed by a more compliant sealant formulation, followed by easily fracturable cement is pumped along the casing 11. The fluid train (described in more detail below) is placed behind the casing 11 into the annular gap between the casing 11 and the formation 12. Thus, the standard cement 133 is placed above the compliant sealant 134 and the fracturable cement 135 in the zone of interest. At some time after setting of the materials behind the casing 11, the fracturable cement 135 and in some cases the formation will be fractured/cracked to allow production from the reservoir formation 122 through the fractures 132, as is shown in FIG. 1D. The compliant zone 134 prevents the cracks 132 from propagating beyond the cement 135 adjacent to the producing formation 122. Suitable materials for the sealant are described below.

In variants of this embodiment (not shown), the properties of the cement 133 and 135 are chosen such that the fractures stop at the interface between the two cements, without requiring an intermittent zone of sealant material 134. Cements with compliant and elastic properties are known as such in the art, for example under the tradename FlexSTONE (RTM) by Schlumberger. Alternatively, it may be possible to use the same type of cement in both zones 133 and 135, provided the sealant 134 prevents the propagation of fractures 132. Suitable materials for the sealant are described below.

The details which follow describe various methods to apply a fracturing force or pressure to cause the cement to fracture at the desired locations within the wellbore.

A controlled load can be applied through the casing and/or sealing plugs for inducing cracks in the cement by means of one or more force or pressure transmitting elements. A contact element can vary in shape, number and position to optimise the process. In one embodiment, the tool applying the force could be repositioned in the casing and the process repeated or a device could be configured as an (vertical) array of such elements.

Figure 2A:
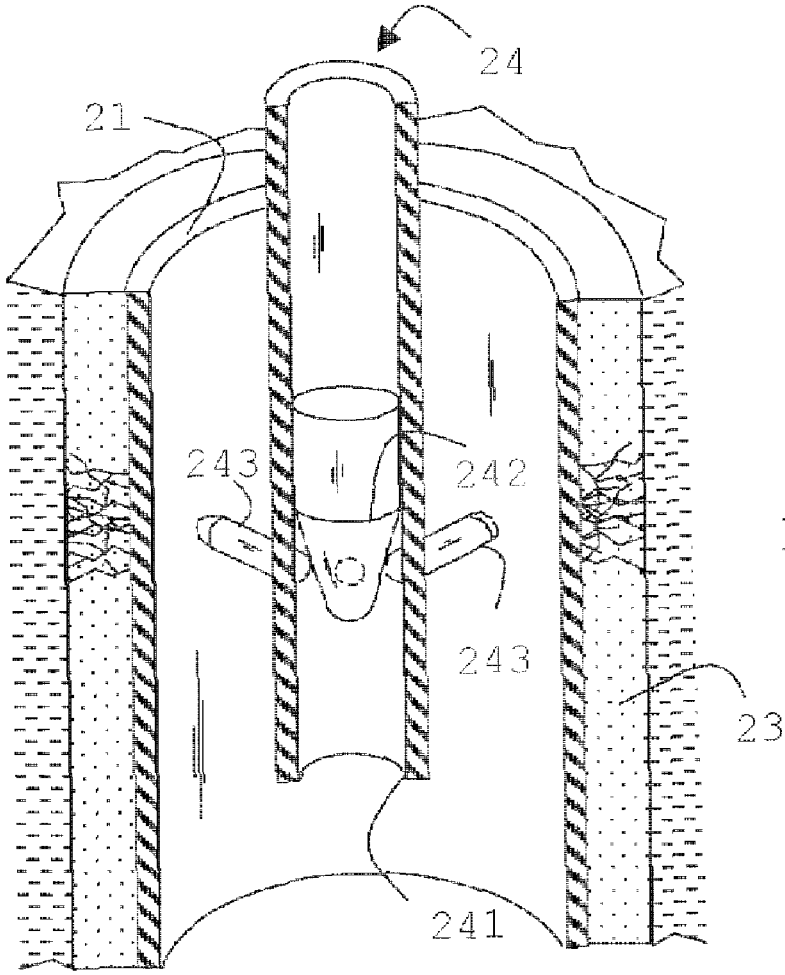
FIGS. 2A and 2B show views of an apparatus according to one embodiment of the invention.
Figure 2B:
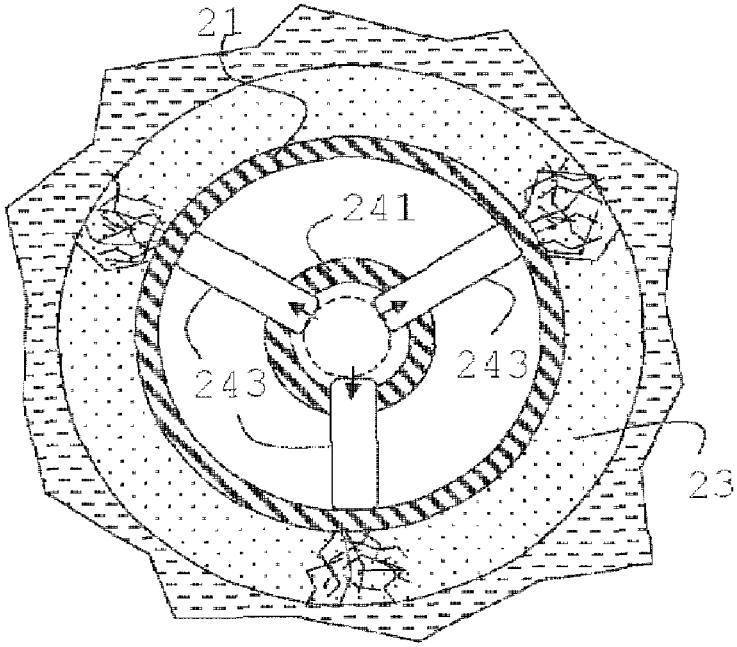

An example of one such downhole tool 24 is shown in FIGS. 2A and 2B. In this example a hydraulic pressure is applied to the top of a conical wedge 242 mounted in a carrier tube 241. Alternatively the wedge can be loaded mechanically via a screw driven by an electric or hydraulic motor (not shown). The wedge in turn transmits a force to the casing 21 by pins 243 fed through the carrier tube 241. The position and number of pins 243 can be designed to optimize the number of fractures produced in the cement 23. The pins could also be used to puncture the casing 21. When using a casing with plugged slots similar to the casing 11 of FIG. 1, the tool 24 can be used to push through plugs which seal openings in the casing during placement and pumping of the cements as described below.

In FIG. 3, there are shown further examples of methods and tools for fracturing the cement locally. In FIG. 3A, the casing 31 is surrounded by set cement 33. The casing has one or more spikes 311 on the cement side, and has an indent 312 on the inside. The cement fracturing tool 34 includes a piston 341 joined to a probe 342 that projects through the tool through O-ring 343 designed to prevent stray materials fouling the spring 344. The piston 341 is sealed by the O-ring 345 and can be activated against the spring 344 by compressed oil or water acting on its face. On activation the probe-tip 342 enters the indent 312, and forces the spike 311 into the set cement 33, causing the fracture 332. The piston 341 is prevented from retracting by a wedge or circlip 346. The tool 34 then travels to the next spike/indent of the casing and repeats the operation as required.

Figure 3A:
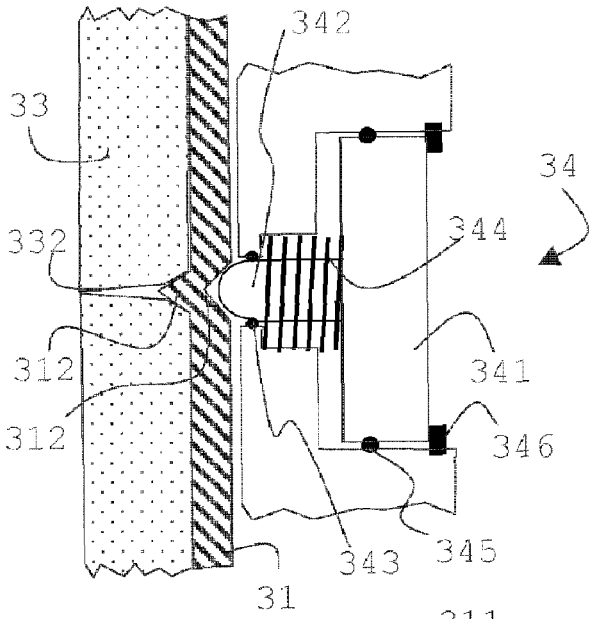
FIGS. 3A-3D shows various forms of casing and adapted tools for use in the present invention.
Figure 3B:
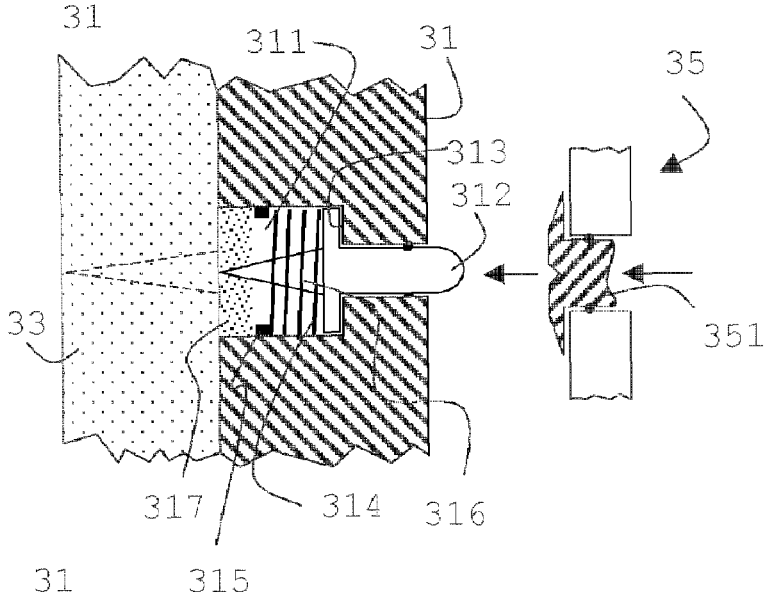

FIG. 3B shows a modified casing which includes movable elements to fracture the cement locally. The set cement 33 abuts casing 31 holding one or more cavities 311, each containing a piston 312 normally held against backstop 313 by spring 314. The assembly is held in position by a circlip 315. The cement side of the piston 312 has spike 316 and a soft plug material 317, which prevents the ingress of the unset cement into the piston/spring region 311. Following the cement set, the piston is pushed by a tapered plug 351 (shown in part), housed in a tool 35, under the action of hydraulic pressure. Any other available force, e.g. derived electrically in wireline conveyance, or hydraulically in coiled tubing conveyance could be envisaged to generate the force to push the spike 316 against the cement 33. The spike 316 causes the cement to fracture. Fluids produced through the fracture may flow either through slots in the casing such as shown in FIG. 1 above, or, using the cavity 311 in the casing 31, through a hole (not shown) in the centre of the piston 312 and or a combination of the two. In all cases the modified casing may contain spikes of different protrusion allowing selection of fracture size, position and number. These spikes may also sit along side holes containing oil soluble resin as plugging material.

Figure 3C:
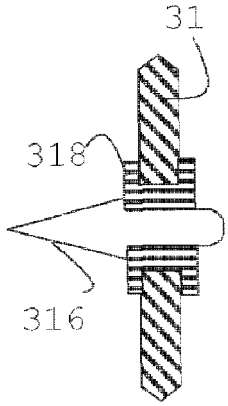
Figure 3D:
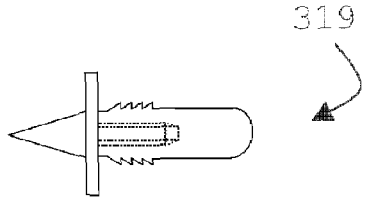

In simplified embodiment, shown in FIG. 3C, the spike 316 protrudes from the casing 31 either partially or fully embedded into a plug of elastomeric material 318 which provides an elastic but fluid tight mount for the spike.

In the embodiments of FIGS. 3A-3C the spike could be held in position after the cement has been fractured initially by means of a frictional material, or a device containing grooves (dents) or seats in the piston. Such a variation in the surface of the piston has been presented by in FIG. 3D as 319. Other variations to locate the spike without retraction while maintaining stress could be envisaged.

In some situations these spikes may contain sensors that would monitor the flow, temperature and composition of produced fluid.

Alternatively when the casing is of reduced thickness an elastomer may be used stand alone to position the insert and prevent cement leakage (see FIG. 3B). The insert, spike or pin could protrude into the cement on the outside of the casing prior to applying a load.

Figure 4:
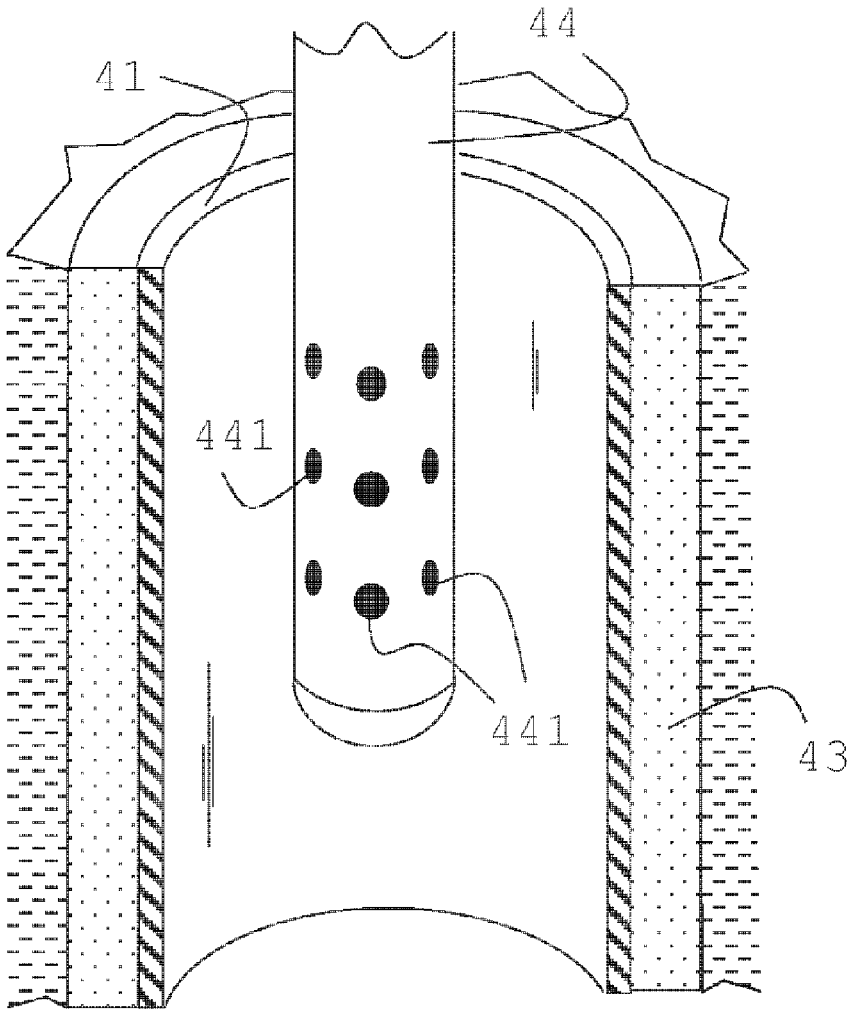
FIG. 4 shows a tool for generating shock waves to fracture cement.

Another alternative to apply controlled pressure is to use explosive devices to increase the hydraulic pressure inside the casing to shatter the cement in the annulus or shaped charges which create a local pressure wave. The suggestion of Teplitz in U.S. Pat. No. 3,026,936 to use bullets to punch holes in the casing or shatter the cements does not afford a similar control over the pressure ranges and location of the force when compared to the methods of the present invention operating explosive charges without bullets. The explosive devices could penetrate or not penetrate the casing. In the example of FIG. 4, a coiled tubing conveyed gun 44 is shown lowered in the wellbore. The gun carries a plurality of explosive charges. The explosive charges could be encapsulated in small pressure chambers 441 which are exposed to the fluid and efficiently couple the shock wave to the casing 41. This creates a large hydraulic shock to the casing, which is beneficial in shattering the cement 43.

Perforating devices (explosives) have been used to punch holes in the casing and penetrate the formation to enhance production. There has been some evidence of the cement shattering especially near the perforated hole and when used in high density. Tubing punchers, which are simple perforating charges with very low penetration, could be used to just penetrate the casing.

The explosives may be replaced by electromagnetically operated hammer deployed on a wireline tool. The hammer is placed close to the casing, and is activated, ringing on the casing, the shock waves causing the cement to crack in a known manner.

Controlled vibrational energy can also be used to crack the cement. Again, using a wireline deployed device a ring can be expanded from a small collar and clamped to the casing. A shaker device of a known or optimized frequency can then excite the casing with sufficient high frequency energy to cause radial cracks. The frequency and magnitude of the vibration can be tailored to the depth and ambient pressure and temperature to optimize the size of the cracks that are formed. The acoustic source could have the secondary and beneficial effect of reducing the viscosity of produced oil.

Another approach is to apply heat to the casing surface to encourage the cement to expand and crack, while reducing the viscosity of the hydrocarbon fluid.

For example, localized heating using radiation or induction can be deployed to crack the cement in predetermined zones. In this case a tool is lowered on a wireline to deliver 9 kW (and even higher bursts) of energy. This energy can be converted to heat with focused probes (in a manner similar to the pins described above). The pins focus the thermal energy into the cement in a very precise manner.

Another solution is to use a mandrel, similar to those used for expandable casing. The mandrel is pulled from the surface thus deforming a section of the casing as desired. The shape of the mandrel can be tailored to induce a permanent amount of deformation of the casing, ensuring not only that fractures will be created but also that they will remain open. The amount of deformation can be tailored to induce cracking in the cement in both tension and shear, and to increase the density of fractures when such a feature would be beneficial. More than one mandrel can also be used for further casing expansion and cement cracking if required. In some situations the mandrel may contain chemicals that can alter the surface properties of and or all of the casing, the cement and the filtercake.

A controlled expansion of the casing may also be achieved by using hydraulic pressure applied inside the casing.

In addition to the steps described above electrical fields, gamma rays, or X rays may be used to degrade the cement prior or after the fracturing.

Figure 5A:
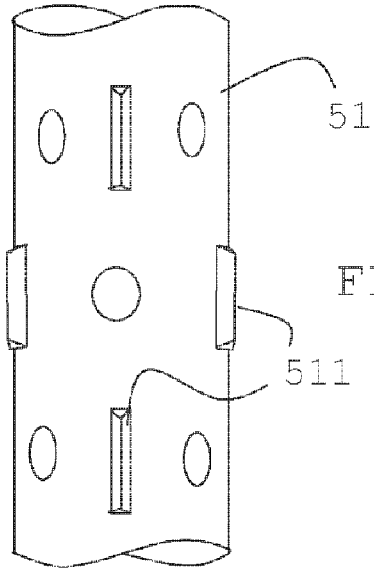
FIGS. 5A-5C show casing with force- or pressure localizing elements in accordance with the invention.
Figure 5B:
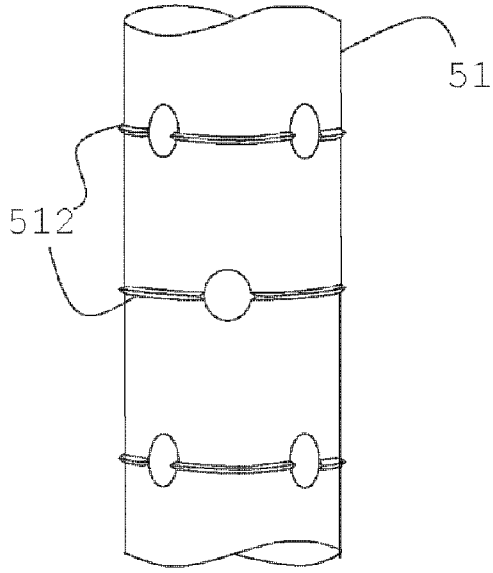
Figure 5C:
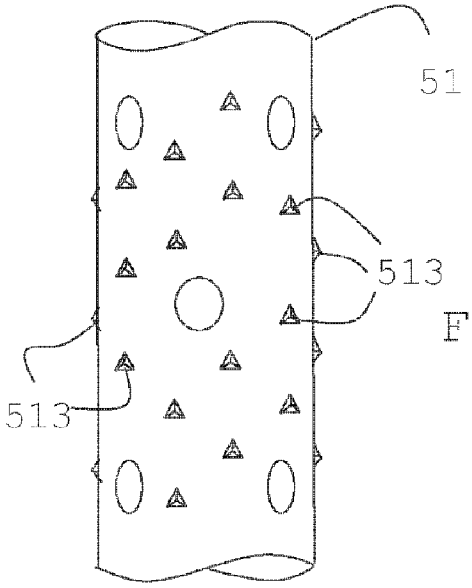

Of these potential alternatives as sources of a fracturing force, some, for example hydraulic pressure, heat or other means of expanding the casing are not easily confineable and are likely to lead to fractures outside the desired zones. In such cases, the distribution of cracks in the cement can be localized and controlled by the surface topography of the casing 51 in contact with the set cement. Examples of some of the casing configurations suitable for such a purpose are presented in FIGS. 5A-5C and include axial knife-edge ribs 511, circumferential knife-edge ribs 512 and pointed protrusions 513, respectively. Other force or pressure transmitting elements and combinations of any of the above described can be used.

If using a conventional casing string such casing is perforated or cut after placing and setting the cement. Such alteration of the casing would require the use of a perforation tool as described above, a casing drilling tool or a water jet. The water jet can be held close to the casing surface by magnetic arms and rotated in contact with various positions on the casing. The nozzle diameter and speed of displacement can be used to control the slot width. The jet may be provided by a downhole pump and a tractor conveyed on a wireline. In another variation of this approach it could be possible to increase the power available by pumping fluid down a coiled tubing to power a downhole pump.

However, it is preferable that the casing is modified to allow the carrying out of a completion in accordance with the present invention as a part of the primary cementing process.

Hence, any of the above variants benefit from the use of casing such as described in FIG. 1 having slots or milled weak regions or mesh-type openings, which are covered, plugged or cut to less than the casing thickness to hold a minimum amount of pressure differential. The cover or plug would rupture or be punctured when the fracturing force is activated. Alternatively, the cover or plug is dissolved by fluids which can either be pumped from the surface or are effluents from the formation. An example of such a casing or screen is shown in FIG. 6.

Figure 6:
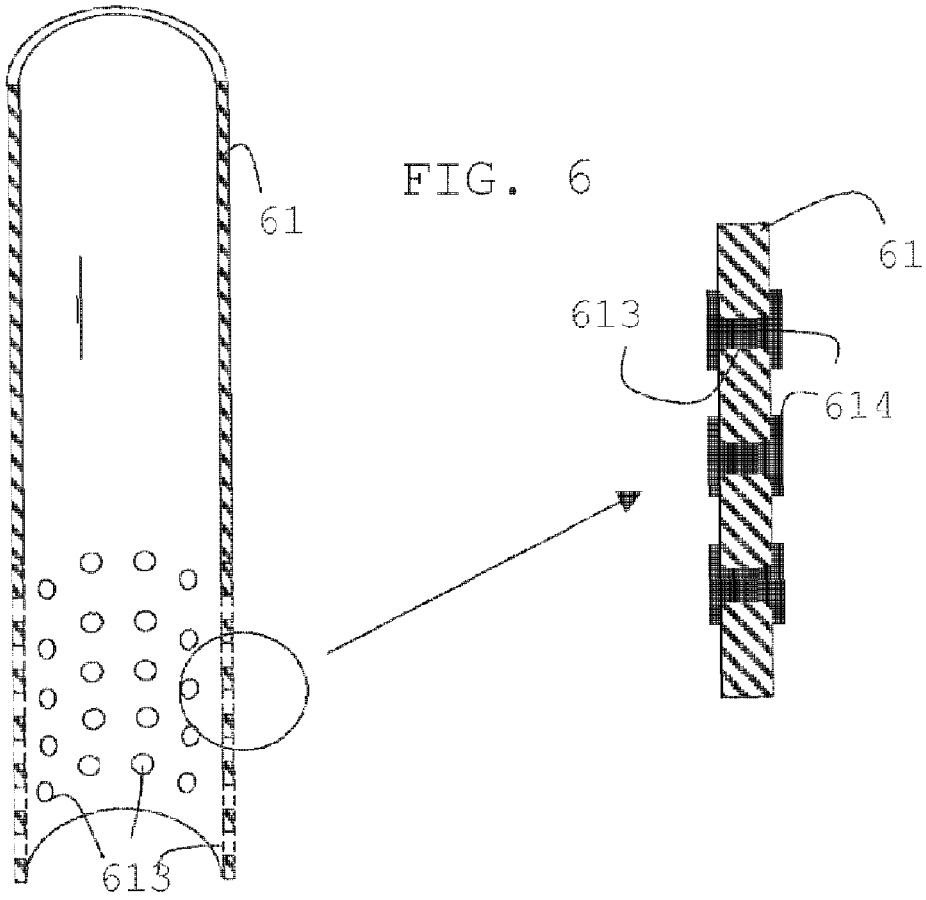
FIG. 6 shows casing with pre-formed openings.

In FIG. 6, the lower half of casing tube 61 has a plurality of openings 613 each filled during placement and pumping of the cement with a plug 614 as shown in the enlarged view.

The plug material can be an oil soluble resin, a brittle material or a material with a high thermal expansivity. Such plugs can be arranged to crack or melt during the hydration of the cement or dissolve in contact with oil or water. Alternatively they may be melted or broken on casing expansion or dragged out of position by a tool run in the hole after the cement has gelled but before it has set.

In general, the openings in the casing or screen will preferably have a width less than the domains in the fractured cement (as an extra safeguard against complete failure and sand production), preferably at most 2.5 times the diameter of the sand particles of the formation. The remaining cement fragments are likely to be much larger than the particles (probably in the range of 0.3 mm to 1 mm) and will then not be produced through the casing or screen. The screen or casing has a permeability greater than the fractured cement but it can have areas that remain unperforated to prevent collapse and eliminate the need for extra circular (ring) supports in the wellbore. These areas without openings may contain multiple surfaces that are conical or wedged in shape as are described above in an example above.

Though conventional casing is made of steel, other metallic and/or non metallic (e.g., polymeric or composite material) casings can be envisioned for the present application.

Figure 7:
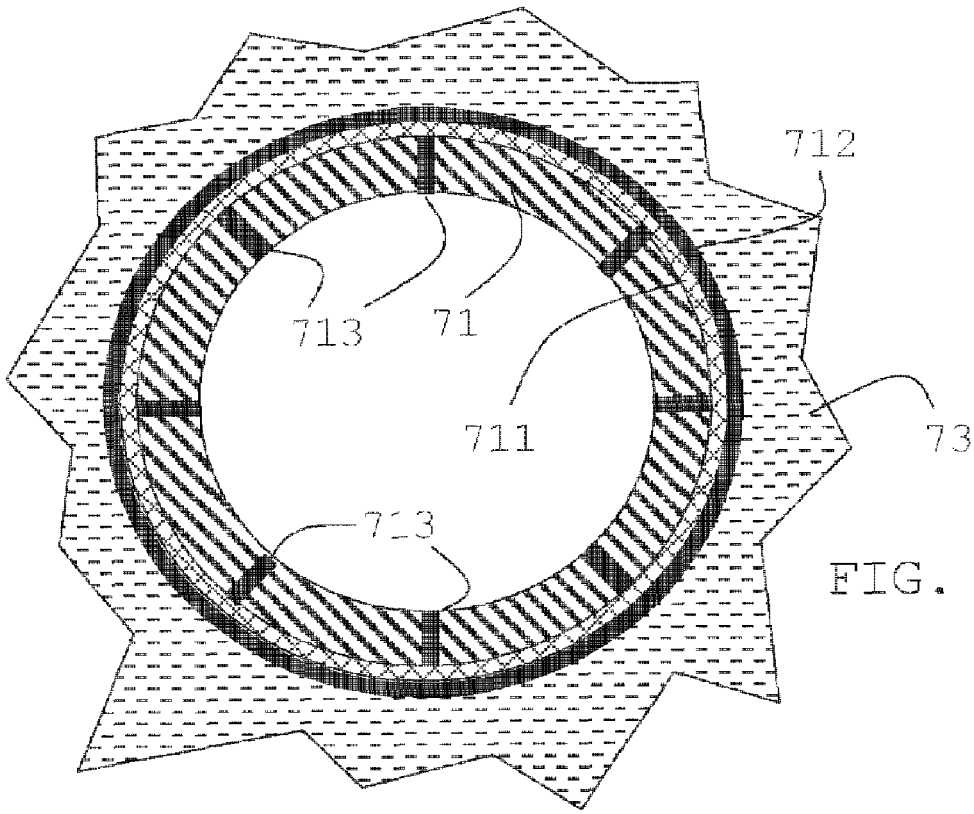
FIG. 7 illustrates another example of casing adapted in accordance with the invention.

A schematic of an alternative modified casing is presented in FIG. 7. In this approach a wire mesh 711 is attached to the back of the perforated or slotted casing 71. The mesh can be coated on the outside with an oil or water soluble polymer 712 which allows the placement of the cement 73 as slurry during the primary cementing at the back of the casing. As the oil or water penetrates the holes/slots 713 in the screen it will reach the polymer coating and solubilize it. The pressure is applied to the cement through the holes in the screen which will reduce the required fracture stress.

Alternatively the coating 712 will be altered by the high pH (≈13) environment of the cement and fracture when extra stress is applied in the wellbore. This variation on the screen allows for primary cementing, reduced cement failure pressures, increased permeability (connectivity) behind the screen, and maximize the effect of shrinkage stresses in the cement.

Referring now to desirable and preferred properties of the cement material for use in the present invention, the important properties of the cement are its shrinkage, compressive strength, elastic properties and hydraulic permeability. These properties will determine the properties of the cement and the way it can be fractured.

Shrinkage (after gelation) of a standard class G cement slurry has been observed with a resultant strain on the casing of 0.01%. A laboratory experiment showing this was carried out in the absence of excess water and the result was the generation of a tangential tensile stress and tensile fractures developed from the outer surface towards the casing. Maximising the shrinkage of a cement slurry while reducing the tensile strength can lead to natural fractures in the cement. After placement of cement, the bottom hole temperature will rise (sometimes by as much as 20° C.) increasing the tangential tensile stress in the cement. Software simulations were carried out using standard cement slurry inputs and sandstone as the formation and a 7 inch (178 mm) casing. The set cement had a Young's modulus E of 5 GPa and a tensile strength of 3 MPa and failed in tension if the casing was expanded by 0.13%. For a more brittle or an unconsolidated formation the failure in such a cement would occur at even lower casing expansions. The stress required for fracturing the cement may also be altered, preferably reduced, by the presence of a layer of filter cake between the formation and the cement or by the presence of a gap or micro-annulus between the formation and the cement. Such a gap can be caused by a significant shrinkage of the cement during setting.

Using an approximation to a thin walled cylinder for a free standing 7 inch casing, such an expansion would require a pressure differential of ca 15 MPa. Using the software simulation and allowing for strain in the cement and rock, a pressure increase of 37 MPa would be required for tensile failure and 80 MPa for a combined tensile hoop stress and compressive radial stress. Altering the Young's modulus E and Poisson's ratio $\nu$ of the modified casing to values for cement would reduce the required pressure to around 15 MPa and changing the steel to non-metallic material (e.g. plastic) ($E$=200 MPa, $\nu$=0.45) reduces the wellbore pressure required for fracture to around 13 MPa.

A flexible cement is not required for this completion technique. Instead, a brittle material with the lowest possible tensile strength is preferred. In some situations the rock will be fractured at the same time as the set cement is fractured, giving the potential of bypassing the internal or external filter cake which often forms an additional layer between cement and formation.

The design of a cement based material in which multiple radial fractures can be induced and microcracking established while limiting the crack tortuosity is important. This material may be a conventional cement slurry, i.e., cement and water mixed with or without other additives. Alternatively it can be a cement designed to be permeable that can be remediated by refracturing. After fracturing, the resulting permeability is however much greater than the initial values of permeability. The cement could also be vibrated by an acoustic source to remove debris from the fractures. The formulations would allow variation in the density range and the addition of fluid loss additives. Free water development could be minimized or maximized as required depending on the well orientation. The water to cement ratio will vary between 0.2 and 0.6 and other additives will be used to alter the stress response. Included in the formulation would be a dispersant, retarder and antifoam agent as for conventional systems. Approaches to minimizing fracture distribution could be non bonding particles with oil soluble or hydrophobic layer aggregate addition fibres or plates for fracture propagation and solubilization solubilization coalescence of emulsion droplets oil swelling particles to give fractures by osmotic swelling maximized shrinkage In some variation of the above list hydrophobic particles or polymer can be added to the matrix to reduce the impact of water production on the cement matrix, such as scaling or matrix dissolution.

Generally particles are added to cement in the oil industry to alter density and enhance strength and flexibility. These particles can be mineral based or polymer based. The particles can have any shape from fibres to plates to spheres. Other complex geometries may apply.

Aggregates alter the stress distribution in the cement matrix and also the structure of the set cement at the interface. Fracture redirection at the aggregate-cement interface can lead to an increased permeability especially if the particles were dislodged during oil production. Aggregate particles can have a diameter as large as 1 mm. These aggregates can be minerals from silts, clay, granite, pyrex, slag, fly ash, crushed concrete, wood or carbon black. These particles may be added to increase the brittleness of the cement.

Alternatively at temperature the fracturing of the cement based composite could be facilitated by the differences in coefficients of expansion between the cement and aggregate, pore pressure reduction leading to increased effective stress and at extreme temperatures the decomposition of hydrates. The fracture of cement without filler could also be achieved if a percentage of the cement remains unhydrated. Then the fractures would form through the silicate gel, calcium hydroxide crystals and around the unhydrated cement particles.

In an alternative formulation non bonding particles with oil soluble layers could be added. This oil soluble layer could result from an asphaltene and/or resin emulsion added to the initial formulation.

The fracturable cement may consist of oil droplets as well as Portland cement, an emulsifier, cement retarder and water. The density of the formulation may be adjusted as necessary. The surfactant may be unstable at high pH and temperature resulting in coalescence. During a fragmentation process cement matrix fragments and the oil filled pores are connected. These oil-wet pores fill with oil from the reservoir and surface layers may prevent the precipitation of calcite or other minerals should water be produced.

Particles of wood, polymer, clay, polypropylene, rubber and hydrogel may be chosen at high volume fraction such that the swelling stresses when in contact with oil could assist in the fracture of the remaining cement matrix.

Cement shrinks on setting because the volume fraction of products is less than that of the reactants. Once gelation has taken place the absence of excess water can further increase the shrinkage of the cement. Water uptake from a permeable formation can be prevented by the addition of permeability reducing agents in the cement slurry. Such shrinkage could lead to cracking in a radial geometry. This shrinkage could be maximised by increasing the concentration of aluminate phases in the cement or by altering the water to cement ratio. Alternatively expanding agents such as calcium and magnesium oxides may be added to increase the stress in the cement matrix further.

The concept of permeable cement for reservoir completions is not new in the oil industry. These materials contain foam, oil droplets or degradable particles. These materials could form the basis of the special cement for this application.

The sealant depicted as 134 in FIG. 1C and 1D is designed to prevent the transmission of fractures upstream and/or downstream behind the annular gap or to act as a pressure seal. This material can be a modified cement or an organic material. Suitable materials for such a seal are described for example in detail in the United Kingdom Patent Application No. GB 2398582. The material is a set material that is flexible and has a Young's modulus of around 1000 MPa or lower. The material can be placed in compression or can swell in contact with oil.

In case the fracturing of the cement requires a layer of filter cake between the cement and the formation, existing drilling fluids and/or methods of removing the filter cake may have to be modified so as to ensure the presence of such a layer. However, in other cases the presence of the filter cake may reduce the flow through the fractured cement and hence, the complete removal of the filter cake may be warranted.

In conventional horizontal cementing, centralizers may be required to be placed at 6 m intervals to achieve the recommended API stand-off of at least 67% and allow proper cement placement. For these applications, a centralized casing is preferred. However, standoff is not critical as perfect hole cleaning is not necessary. Centralizers can be further apart than 6 m and can be reduced friction rollers or specialized filtercake removers. Alternatively the centralizers might be designed and placed so as to allow turbulent placement of the cement to facilitate filtercake removal.

Drilling mud filtercake is formed on the outside of the reservoir rock and if the rock permeability is above ≈50 mD polymers (xanthan, starch, scleroglucan) from the reservoir drilling fluid could invade the rock. This invasion would lead to reduced productivity. It may not be possible to carry out any of the conventional cleanup practices after the cement has been placed. One option is to drill the zone of interest underbalanced reducing invasion and thus the creating of a filter cake. Alternatively the shrinkage of the cement on setting can leave the filtercake unsupported with a pressure between the filtercake and the cement. Produced oil can rupture the filtercake and possibly displace the internal solids. There is also the potential for the filtercake to be modified during the expansion of the cement. In another approach the filtercake may be embedded into the cement during fracture and dislodged by the use of an acoustic cleanup tool. Alternatively a fluid carrying an enzyme-based breaker can be injected through the cement. Alternatively the cake may be partially removed by the passage of cementing fluid. The invasion of cement filtrate into the formation can be prevented by the addition of fluid loss additives to all the cement based formulations. In this situation the use of acoustics to clean up the fractures in cement and dislodge the internal cake is a possibility. A fracturable cement containing fluid loss additives can limit the invasion of the cement solids into the formation.

The permeability of the fractures generated in accordance with any of the methods described above can be enhanced or recovered using an acidizing treatment. Optimized acidic solutions can be squeezed into the fractured cement for clean up or used to increase the permeability of the cement prior to further fracturing. Such acids, for example a mixture of 12% HCL/3% HF, can be spotted along the surface of the casing. The acid can also comprise acetic, formic or citric acids or mixtures of the above.

Alternatively, materials such as those used for squeeze treatments can be used to block unwanted or large fractures in the cement. The material can be cement based or an organic material or a combination of both. The material can be injected during water production or in exceptional circumstances when sand is produced through the screen. Such remediation allows complete control and drilling ahead if necessary.

The remedial fluids can be conveyed downhole in coiled tubing or it could be presented to the casing inside a spike or pin (as described above) used for fracturing.

The scope of the present invention may be extended for use in gravel pack tools for cased hole remediation or prepacked gravel packs. Variants of the present invention may include the step of placing a layer of settable material inside a perforated casing and using any of the above described methods to fracture solid blocks or sheath of settable material and thus converts them into functional equivalents of the conventional gravel packers. The placement and fracturing of the cement in this case may require the use of packer technology to isolate the sections of the well in which a gravel packer is to be placed.

Gravel packs typically have a permeability of 40-50 Darcy. Although being much larger than typical formation permeabilities, this is designed to allow for a reduction in permeability of the pack during its service lifetime owing to partial blockage by particulates such as produced sand or filter cake residues. In a simple model of linear and constant-width radial fractures in the cement that connect the casing to the formation, it is readily shown that the permeability for radial flow is given by $k=\epsilon w^2/12$, where w is the width of a fracture and $\epsilon$ is the fracture porosity, i.e. $\epsilon$=(volume of linear fractures)÷(total volume of the cement). The particle sizes of produced sand are typically from 0.1 to 5 mm, so that the cement fracture width should optimally be about 0.1 mm, although larger widths may be allowable if it is known that the produced sand is larger. Taking a crack width w=0.2 mm and a typical crack porosity of 0.01 gives $k=30\times10^{-12}$ $m^2$, or ~30 Darcy, close to conventional gravel pack permeability. This crack porosity can be accounted for given the shrinkage levels expected from a cement in the wellbore of 0.5% or higher. This is subject to the same degradation by particle blocking over time as described above for gravel packs. Hence, cements sheath or blocks when placed inside the cased wellbore and cracked or fractured using any of the above methods can replace convention gravel packers in wellbore completions. One of the advantages of such a new gravel packer is its potential to be initially placed downhole as a slurry and can also be subject to subsequent remediation (or refracturing) treatment when being blocked as described above.

Figure 8:
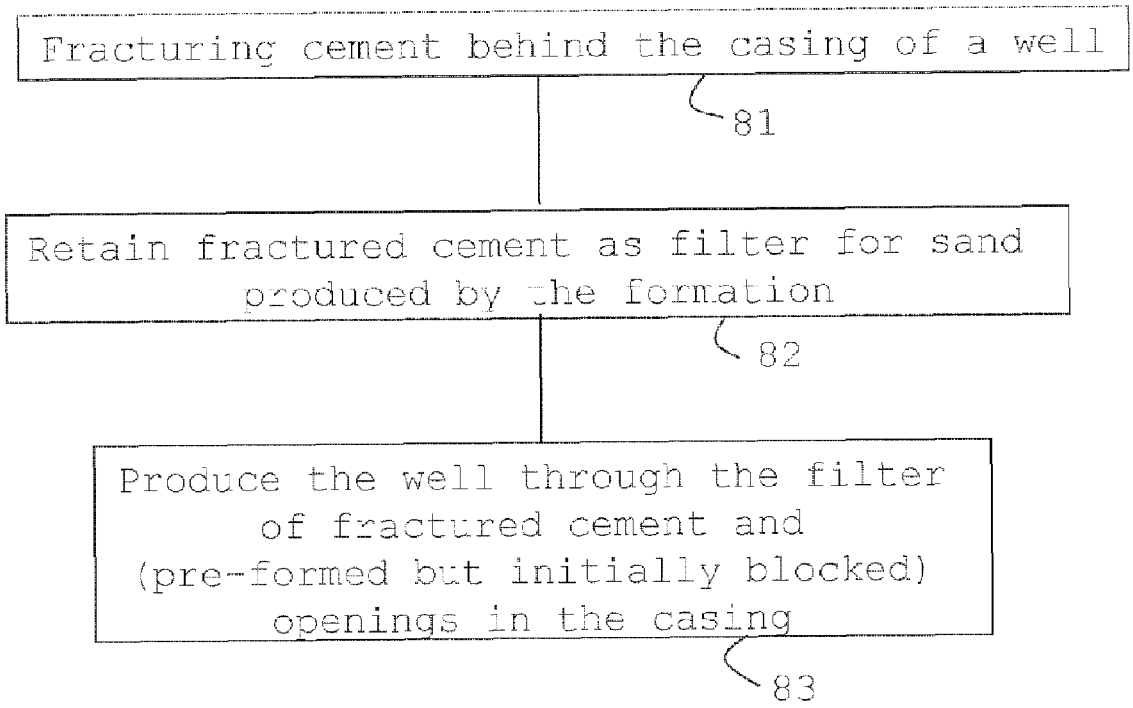
FIG. 8 is a flowchart of steps in accordance with an example of the present invention.

The flow chart of FIG. 8 describes some steps in accordance with an example of the present invention including the step 81 of fracturing locally cement being the casing of a well, the step 82 of retaining a layer of such fractured cement as a sand filter and the step 83 of producing the well through the filter and (optionally preformed but initially blocked) openings in the casing.

What is claimed is:

1. A method of establishing a fluid communication in a well between a formation and a tubular casing, said method comprising the steps of:

providing a casing, wherein the casing comprises:

one or more protruding elements within or on an outer surface of the casing and projecting outward from the outer surface; and one or more openings in the casing, wherein the one or more openings and the one or more protruding elements are proximally located on the casing;

pumping a fluid train into an annulus between the casing and the formation, wherein the fluid train comprises at least a settable material and a compliant sealant, and wherein the fluid train is configured to provide that after the fluid train is pumped into the annulus a layer of the compliant sealant is disposed in the annulus on top of a layer of the settable material;

fracturing the layer of the settable material after the settable material has set, wherein the step of fracturing the layer of the settable material comprises applying a force to the protruding elements;

and wherein the fractured settable material blocks the passage of formation sand and other solid particles through the openings and the layer of the compliant sealant prevents fractures spreading up the annulus beyond the layer of the settable material.

2. The method of claim 1 wherein the step of fracturing the layer of the settable material comprises applying localized deformation to the casing adjacent to the protruding elements.

3. The method of claim 1 wherein the step of fracturing the layer of the settable material comprises applying localized shock waves to the casing adjacent to the protruding elements.

4. The method of claim 3 wherein the localized shock waves are caused by firing explosive charges.

5. The method of claim 4 wherein the localized shock waves are caused by firing shaped explosive charges without projectiles.

6. The method of claim 1 wherein the protruding elements comprise ribs on the outer surface or pointed or blade-like elements.

7. The method of claim 1 wherein the location of the fractures is confined using heat or radiation localizing elements on the casing.

8. The method of claim 1, wherein the settable material includes additives that promote the formation of fractures or cracks.

9. The method of claim 1, wherein the settable material comprises a cementious material.

10. The method of claim 1 wherein the fluid communication is enhanced by providing that the settable material is permeable after setting.

11. The method of claim 1 further comprising, applying an acidizing treatment to the fractured layer of the settable material.

12. The method of claim 1 performed during the primary cementing of the casing after the placement of the casing but prior to the initial production.

13. The method of claim 1 performed as remedial treatment after the onset of production.

14. A method of establishing a fluid communication in a well between a formation and a tubular casing, said method comprising the steps of:

providing one or more protruding elements within or on an outer surface of the casing, wherein the protruding elements project outward from the outer surface;

pumping a fluid train comprising a settable material and a compliant sealant into an annulus between the casing and the formation; and fracturing the settable material after setting, wherein the fracturing of the settable material comprises using the protruding elements as force or pressure transmitting elements to confine a location of the fracturing of the settable material, and wherein:

the casing includes pre-formed openings, the openings being blocked by a blocking material;

the preformed openings are proximal to the one or more protruding elements;

the compliant sealant is configured in the annulus to localize the fracturing of the settable material to the location; and after fracturing of the settable material at the location, the openings of the casing are separated from the formation by a layer of fractured settable material designed to prevent sand or solid production.

15. The method of claim 14 wherein the blocking material is removed after the settable material is set.

16. The method of claim 14 using the fracturing step to simultaneously remove the blocking material.

17. The method of claim 14 using fluids produced from the formation to remove the blocking material.

18. The method of claim 14 wherein the blocking material comprises plugs of dissolvable material.

* * * * *